United States Patent [19]

Wilson et al.

[11] Patent Number: 4,572,293

[45] Date of Patent: Feb. 25, 1986

[54] METHOD OF PLACING MAGNETIC MARKERS ON COLLARLESS CASED WELLBORES

[75] Inventors: James G. Wilson, Hobbs, N. Mex.; Gerald J. Crawford, Tulsa, Okla.

[73] Assignee: Standard Oil Company (now Amoco Corporation), Chicago, Ill.

[21] Appl. No.: 646,617

[22] Filed: Aug. 31, 1984

[51] Int. Cl.[4] ..... E21B 47/09

[52] U.S. Cl. ..... 166/250; 166/66.4; 166/255

[58] Field of Search ..... 166/250, 255, 65 M, 166/66, 65 R

[56] References Cited

U.S. PATENT DOCUMENTS

| | | | |
|---|---|---|---|
| 2,698,920 | 1/1955 | Gieske | 166/255 X |
| 3,019,841 | 2/1962 | Ternow | 166/255 X |
| 3,114,876 | 12/1963 | Schuster | 166/255 X |
| 3,393,732 | 7/1968 | Murphey, Jr. et al. | 166/255 X |
| 3,396,788 | 8/1968 | Bell | 166/255 |
| 4,465,140 | 8/1984 | Hoehn, Jr. | 166/250 X |

FOREIGN PATENT DOCUMENTS

| | | | |
|---|---|---|---|
| 458647 | 3/1972 | U.S.S.R. | 166/255 |
| 600287 | 3/1978 | U.S.S.R. | 166/255 |

*Primary Examiner*—Stephen J. Novosad
*Assistant Examiner*—Thuy M. Bui
*Attorney, Agent, or Firm*—Robert R. Cochran

[57] ABSTRACT

To locate wireline tools in wellbores using collarless or butt joint casing, a magnetic marker is applied at selected positions on the casing before or after placing the casing in a well, such marker being capable of being located by a conventional casing collar locator. Apparatus to apply the marker is also shown.

5 Claims, 3 Drawing Figures

METHOD OF PLACING MAGNETIC MARKERS ON COLLARLESS CASED WELLBORES

This invention relates to a method and apparatus for placing magnetic markers in cased wellbores containing collarless or butt joint casing sections.

BACKGROUND OF THE INVENTION

1. Field of the Invention

In well logging practice it is desirable to provide depth markers spaced at known and regular vertical intervals. Such markers are used for depth control of wireline tools during a logging run. This invention relates to the problem of providing depth markers in cased wellbores where the casing used is a butt joint casing string. This type of casing does not have any casing collars.

2. Related Art

With casing constructed of joints which are tied together with a casing collar, it has been the practice to locate each collar in the casing string with a casing collar locator and then correlate these collars to a gamma ray log for precise depth determination in the cased hole. Now with collarless or butt joint casing, some means for relating casing to the gamma ray log or to total depth must be accomplished. One prior art system for doing this comprises the use of false collars which are physically attached to the casing by welding or bolting before the casing is run in the wellbore. Besides the expense of the collar, the collar is subject to being dislodged during insertion thus creating problems in depth control and in setting casing.

As is well known, conventional casing collar locators comprise an electromagnet with the change in field noted as the electromagnet moves past a collar. Such movement generates a voltage signal thus providing a reliable mark every 30 ft.

An object of this invention is to provide a method for locating markers for a wireline tool in a borehole having collarless casing.

Other objects and advantages of the invention will be apparent to one skilled in the art upon reading this disclosure.

SUMMARY OF THE INVENTION

Broadly, one aspect of this invention comprises a method of locating a wireline tool in a borehole having collarless casing, by providing at least selected casing lengths with a magnetic marker at a selected location along the length of the sidewall thereof, and detecting each said magnetic marker with a casing collar locator to correlate with the depth reading of a wireline tool.

The magnetic marker used in this invention can be placed on selected points on the casing prior to running said casing into the wellbore, or the marker can be placed on the casing after it is in place in the borehole. The marker is applied by locating one or more electromagnets adjacent the area to be marked and passing a high direct current density through the coil of the electromagnet.

Another aspect of the invention resides in a method of marking a wellbore casing in a manner such that the mark can be subsequently detected by a casing collar locator comprising placing an electromagnet adjacent said casing and energizing said electromagnet.

BRIEF DESCRIPTION OF THE DRAWING

Accompanying and forming a part of this disclosure is a drawing comprising

PREFERRED EMBODIMENT

Figure 2:
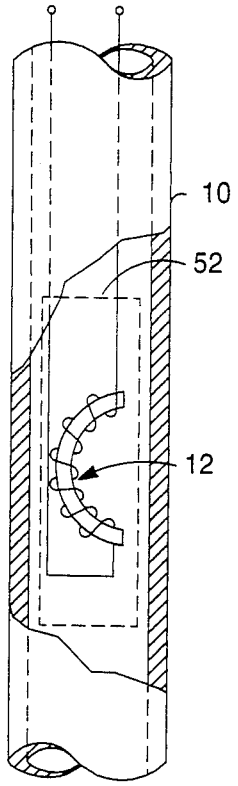
FIG. 2 is a modification of the system shown in FIG. 1.

Now directing attention to the drawing, the invention will be more fully described with relationship to a preferred embodiment. Common reference numerals are used in FIGS. 1 and 2 since these figures represent modifications of the invention.

Figure 1:
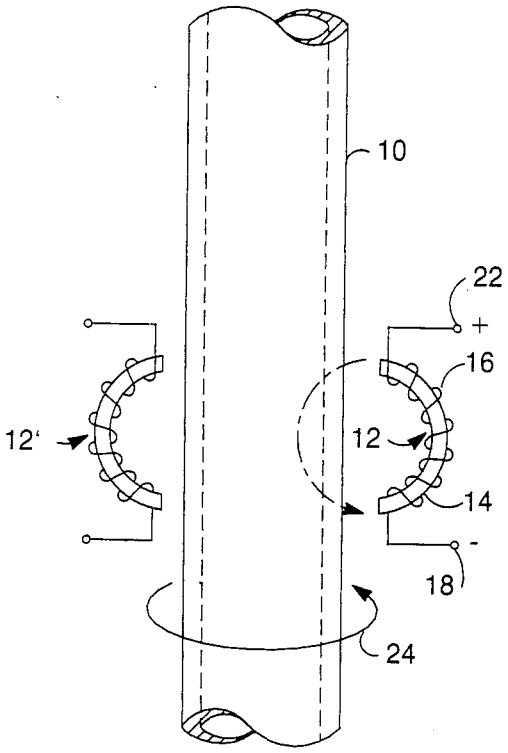
FIG. 1, a view partly in section of apparatus suitable for carrying out this invention.

In FIG. 1, a portion of casing section 10 is represented. Adjacent to the wall of the casing is an electromagnet 12 comprising a hardened horseshoe rod 14 having a large number of turns of wire 16 wound thereon. This coil 16 terminates in terminals 18 and 22. Optionally, one or more additional electromagnets 12' may be positioned in generally horizontally aligned relationship, one being shown in phantom lines in FIG. 1. If desired, means (not shown) can be supplied to rotate the electromagnet assembly on the pipe as indicated by arrow 24. The same casing section 10 is shown in FIG. 2 but in this modification, the electromagnet 12 is positioned within the casing. This FIG. 2 will be further described after the following description of FIG. 3.

Figure 3:
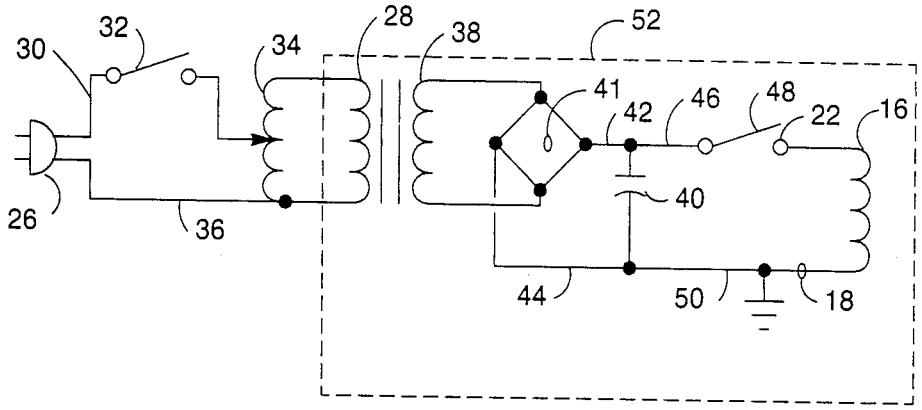
FIG. 3 is a schematic wiring diagram showing the electrical system used in this invention.

FIG. 3 shows one electrical system for suitably energizing the electromagnet 12. A plug 26 is adapted for connection to a suitable alternating current source which is applied to the primary windings 28 of a transformer. This connection is through conduit 30 having switch 32 and voltage control means 34, such as a Variac, therein. Conduit 36 connects the other side of the voltage source to the primary winding 28 of the transformer. The secondary winding 38 of the transformer supplies, in the preferred embodiment, a suitable voltage for each capacitor 40. Voltages of 100 to 500 volts are generally used. The output from the secondary winding 38 of the transformer is supplied to a rectifier bridge 41. The direct current output from rectifier bridge 41 is connected by conduits 42 and 44 to capacitor 40. The output from capacitor 40 can be applied to the electromagnet winding 16 by conduit 46 having switch 48 therein and grounded conduit 50.

In the operation of the electrical system shown in FIG. 3, a suitable voltage is applied from the variable voltage source supply 34 to the primary winding 28 of the transformer, raised to a suitable level in secondary winding 38 and supplied to the rectifier bridge 41. After the capacitor 40 is charged, closure of switch 48 will produce the high current flow desired through the coil of the electromagnet.

When switch 48 is closed, the current flow through winding 16 creates a strong magnetic flux extending between the poles thereof and, when positioned as shown in FIGS. 1 and 2, creates a permanent magnetic marker in the casing 10.

This mark can be applied at a variety of locations around the casing. If the casing is in place in the borehole, one method of applying the marker is to lower the marking system into the bore of the casing 10 on a wireline. In FIG. 3, the apparatus shown within the dashed line box 52 can be assembled in apparatus to be lowered into the casing on a wire line. The same box 52 is shown in FIG. 2 but for ease in understanding the operation of the invention, only the electromagnet 12 is shown in FIG. 2.

Using this system, magnetic markers can be made at any desired point in the casing. Since casing lengths are generally 30 ft, the usual practice of this invention involves marking each length, thus providing 30 ft spacing. However, this new system is not limited to 30 ft spacing. For detection, the distance between markers should be at least 10 ft. The upper limit is not critical—can be 100 ft or more.

The magnetic markers made in accordance with this invention should be strong enough to be picked up reliably even after some loss in strength due to temperature, effects of tools traveling within the casing, etc., and yet not so strong as to impair the performance of or cause damage to sensitive logging instruments, e.g., a gravimeter. A range of 100–200 Gauss is suitable.

The following example illustrates one specific embodiment of the invention but should not be considered unduly limiting.

EXAMPLE

An 8-inch hardened steel drill rod was bent to provide a horseshoe-shaped magnetizable element having the poles about 4 inches apart. This dimension approximates the length of a casing collar. Approximately 2000 turns of No. 30 wire were used in coil 16. The variable voltage source 34 of AC power was adjusted to approximately 120 volts. The transformer provided a secondary voltage output of 240 volts which was rectified and used to charge a 40 mf capacitor 40. Closing switch 48 produced a current to flow through a coil 16, this providing markers of approximately 200 Gauss. The resulting magnetic markers were easily detected inside the pipe section with a casing collar locator.

While the invention has been described with respect to a particular system, it will be understood that considerable variation in the details shown may be made without departing from the broad scope of the invention.

We claim:

1. A method of marking a wellbore casing in a manner such that the mark can be subsequently detected by a casing collar locator comprising placing a horseshoe-shaped electromagnet adjacent said casing and energizing said electromagnet producing a magnetic marker at a location between the poles of the electromagnet.

2. The method of claim 1 wherein the magnetic marker is placed on said casing prior to running said casing in a borehole.

3. The method of claim 1 wherein the magnetic marker is placed on said casing after said casing is in place in a borehole.

4. The method of claim 1 where the markers are placed 10 to 100 ft apart.

5. The method of claim 1 where the magnetic field has a strength of 100 to 200 Gauss.

* * * * *